US009959962B2

(12) United States Patent
Bassett et al.

(10) Patent No.: US 9,959,962 B2
(45) Date of Patent: May 1, 2018

(54) USING MAGNETISM TO MOVE A PHYSICAL OBJECT PROXIMATE A BASE

(71) Applicant: Disney Enterprises, Inc., Burbank, CA (US)

(72) Inventors: Katherine M. Bassett, Pasadena, CA (US); Michael Paul Goslin, Sherman Oaks, CA (US); Blade Alexander Olson, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days. days.

(21) Appl. No.: 14/992,437

(22) Filed: Jan. 11, 2016

(65) Prior Publication Data

US 2017/0200544 A1 Jul. 13, 2017

(51) Int. Cl.

| | |
|---|---|
| ***A63H 33/26*** | (2006.01) |
| ***A63H 5/00*** | (2006.01) |
| ***H01F 7/06*** | (2006.01) |
| ***H01F 7/02*** | (2006.01) |
| ***H01F 7/20*** | (2006.01) |

(52) U.S. Cl.

CPC ..... *H01F 7/064* (2013.01); *A63H 5/00* (2013.01); *A63H 33/26* (2013.01); *H01F 7/0205* (2013.01); *H01F 7/206* (2013.01); *H01F 2007/208* (2013.01)

(58) Field of Classification Search

CPC ..... A63H 33/26; H01F 7/206

See application file for complete search history.

(56) References Cited

U.S. PATENT DOCUMENTS

| | | | | | |
|---|---|---|---|---|---|
| 2,623,326 | A * | 12/1952 | Kinney | A63H 13/00 | 446/357 |
| 4,325,119 | A * | 4/1982 | Grandmaison | G06F 9/226 | 710/5 |
| 4,325,199 | A * | 4/1982 | McEdwards | A63H 17/34 | 446/130 |
| 4,727,299 | A * | 2/1988 | Liu | A63H 33/26 | 310/36 |
| 5,360,366 | A * | 11/1994 | Lin | A63H 13/18 | 446/134 |
| 6,361,393 | B1 * | 3/2002 | Seymour | A63H 27/005 | 446/129 |

(Continued)

*Primary Examiner* — Gene Kim
*Assistant Examiner* — Alyssa Hylinski
(74) *Attorney, Agent, or Firm* — Patterson + Sheridan, LLP

(57) ABSTRACT

In an interactive environment, a user action may dictate what type of action a base device performs using an entertainment object. In one embodiment, the base device includes a controllable electromagnet that uses magnetism to move one or more permanent magnetics mounted in or on the entertainment object. For example, the entertainment object may be a doll or character that jumps, vibrates, slides, or sways in response to a changing magnetic field generated by the electromagnet. Moreover, the user may wear headphones that determine the location of the base device (and the toy) relative to the user. Using this location, the headphones can output 3D positional audio that the user perceives as originating from the location of the entertainment object on the base device. The 3D positional audio can be outputted synchronously with the action performed by the entertainment object to further immerse the user in the interactive environment.

17 Claims, 7 Drawing Sheets

(56) References Cited

U.S. PATENT DOCUMENTS

| | | | | |
|---|---|---|---|---|
| 8,258,663 | B2 | 9/2012 | Smoot et al. | |
| 8,382,550 | B2 * | 2/2013 | Kang | A63H 33/26 446/133 |
| 8,737,035 | B2 | 5/2014 | Smoot et al. | |
| 8,976,501 | B2 | 3/2015 | Smoot et al. | |
| 9,011,197 | B2 | 4/2015 | Smoot et al. | |
| 2001/0045978 | A1 * | 11/2001 | McConnell | A63F 13/00 348/42 |
| 2005/0148279 | A1 * | 7/2005 | Maa | A63H 3/28 446/297 |
| 2006/0044094 | A1 * | 3/2006 | Davis | A63H 33/26 335/220 |
| 2008/0238218 | A1 * | 10/2008 | Lopatinsky | A63H 18/10 310/12.21 |
| 2011/0248807 | A1 * | 10/2011 | Wang | A63H 33/26 335/296 |
| 2013/0045656 | A1 * | 2/2013 | Aigner | A63H 19/24 446/175 |
| 2013/0236040 | A1 * | 9/2013 | Crawford | H04S 7/304 381/310 |

* cited by examiner

USING MAGNETISM TO MOVE A PHYSICAL OBJECT PROXIMATE A BASE

BACKGROUND

Computer graphics technology has come a long way since video games were first developed. Relatively inexpensive 3D graphics engines now provide nearly photo-realistic interactive game play on hand-held video game, home video game and personal computer hardware platforms costing only a few hundred dollars. These video game systems typically include a hand-held controller, game controller, or, in the case of a hand-held video game platform, an integrated controller. A user interacts with the controller to send commands or other instructions to the video game system to control a video game or other simulation. For example, the controller may include a joystick and buttons operated by the user.

While video games allow the user to interact directly with the video game system, such interactions primarily influence the graphical depiction shown on the video game device (or on a connected display), and rarely influence any other objects outside of the virtual world. That is, a user may specify an input to the video game system, indicating that the user's avatar should perform a jump action, and in response the video game system displays the user's avatar jumping. However, such interactions are typically limited to the virtual world, and any interactions outside the virtual world are limited (e.g., a hand-held gaming device could vibrate when certain actions occur).

SUMMARY

One embodiment described herein is an apparatus that includes a base comprising a support surface and an electromagnet disposed in the base and configured to generate a magnetic field at the support surface. The apparatus includes a controller disposed in the base and configured to control the magnetic field generated by the electromagnet according to a predefined gameplay motion pattern configured to induce an entertainment object proximate to the support surface to perform a desired action.

Another embodiment described herein is a system that includes a base including an electromagnet configured to generate a magnetic field at a support surface, a controller configured to control the magnetic field generated by the electromagnet to induce an entertainment object proximate to the support surface to perform a desired action, and a wireless transmitter configured to emit a location signal. The system also includes an audio system including a plurality of speakers, at least one receiver configured to receive the location signal, and a sound controller. Moreover, the sound controller is configured to determine a location of the base relative to the audio system based on the location signal and output a 3D positional audio using the speakers that a user perceives as originating from the location of the base.

Another embodiment described herein is a method that includes activating an electromagnet on a base to affect a permanent magnetic fixedly disposed on an entertainment object to cause the entertainment object to perform a desired action when the entertainment object is proximate to a support surface of the base and receiving a location signal transmitted by the base device at an audio system. The method includes determining a location of the base relative to the audio system and generating 3D positional audio using the audio system that a user perceives as originating from the location of the base, where the 3D positional audio is output synchronously with the desired action performed by the entertainment object.

BRIEF DESCRIPTION OF THE DRAWINGS

So that the manner in which the above recited aspects are attained and can be understood in detail, a more particular description of embodiments of the invention, briefly summarized above, may be had by reference to the appended drawings.

It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

An immersive storytelling environment can use one or more storytelling devices (also referred to as interactive devices) that are each capable of producing some auditory and/or visual effect, to create an immersive and interactive storytelling experience for a user. In one embodiment, the actions performed by the storytelling devices may vary depending on a user action. For example, in an interactive environment, the user action may dictate what type of action a base device performs using a toy. In one embodiment, the base device includes a controllable electromagnet that uses magnetism to move one or more permanent magnetics mounted in or on the toy. For example, the toy may be a doll or character that jumps, vibrates, slides, or sways in response to a changing magnetic field generated by the electromagnet in the base device. The different actions performed by the toy may correspond to a particular user action. For example, each action performed by the toy may correspond to particular hand gesture performed by the user.

In another embodiment, the storytelling environment may include headphones worn by the user that generate 3D positional audio (or stereophonic sounds) according to the location of the base device. To do so, the headphones may include a detector (e.g., an infrared (IR) receiver) that receives location signals transmitted by the base device. Using these signals, the headphones determine a relative location of the base device which is then used to output sound which is perceived by the user to originate from the base device. In another embodiment, instead of receiving location signals from the base device, the headphones may include a camera or other image sensor that recognizes objects in captured images and determines their location relative to the headphones. The headphones can then output the 3D positional audio in a manner that causes the sound to be perceived by the user to originate from a particular object in the captured images.

Figure 1A:
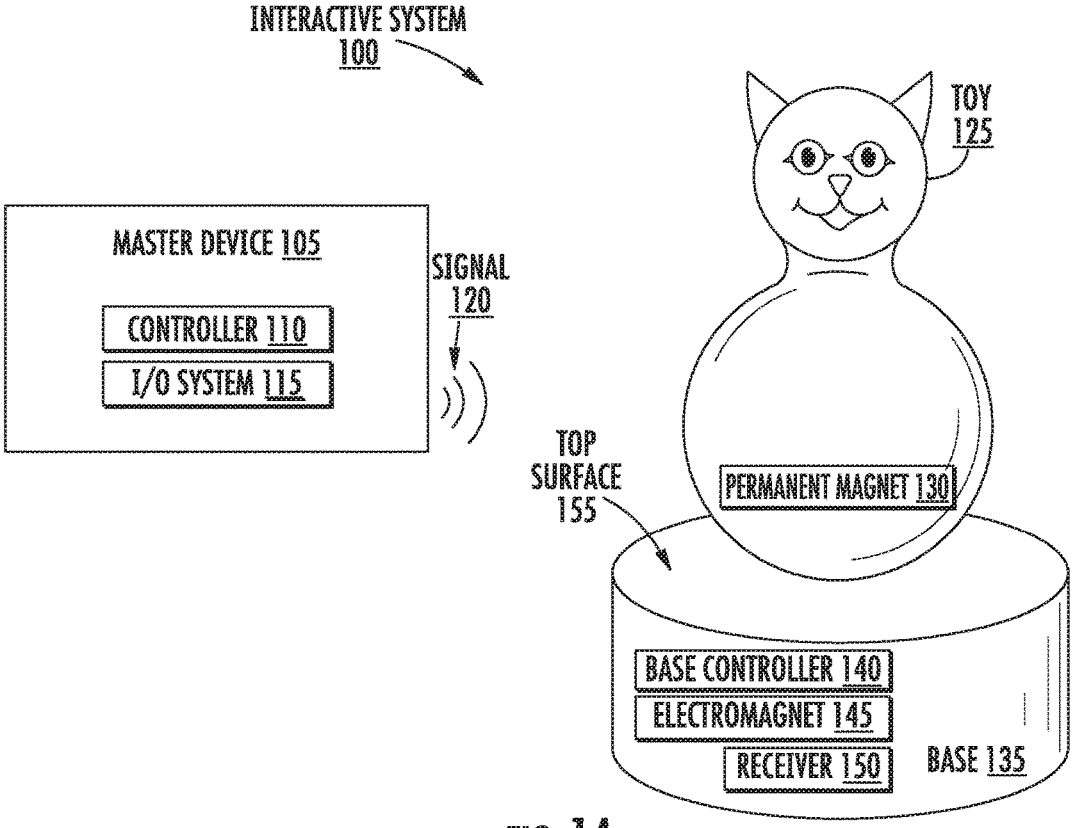
FIG. 1A is a system for using magnetism to enable a user to interact with a physical object, according to one embodiment presented herein.

FIG. 1A is an interactive system 100 for using magnetism to enable a user to interact with a physical object, according to one embodiment presented herein. As shown, the system 100 includes a master device 105, a base 135, and a toy character 125. The master device 105 includes a controller 110 and input/output (I/O) system 115. The controller 110 may include one or more processors, firmware, and/or software for transmitting instructions to the base 135 (also referred to as a base device). The I/O system 115 may include one or more devices for transmitting instructions to the base 135. As shown here, the I/O system 115 includes a wireless transmitter (e.g., IR transmitter or a radio transmitter) for sending wireless signals 120 to the base 135 which contain instructions. Alternatively, the I/O system 115 may include a wired connection to the base 135.

In one embodiment, the I/O system 115 also includes a device for detecting user action. For example, if the master device 105 is worn by the user, the I/O system 115 may include motion sensors—e.g., accelerometers and/or gyroscopes—for detecting motion and orientation of the user. Using the outputs of the motion sensors, the controller 110 may identify predefined user gestures or actions which are mapped to corresponding predefined actions to be performed by the toy 125. For example, the user gesture may simulate a magic spell, and in response, the I/O system 115 transmits an instruction to the base 135 to cause the toy 125 to perform an action—e.g., vibrate or sway. In another embodiment, the I/O system includes a camera or motion capture device that monitors the movements of the user. For example, instead of being worn by the user, the master device 105 may be external to the user and use a camera to detect user actions.

Illustratively, the base 135 includes a base controller 140, electromagnet 145, and receiver 150. In operation, the receiver 150 receives the wireless signals 120 (containing instructions) transmitted by the master device 105. The base controller 140 may include one or more processors, firmware, and/or software for decoding the instructions received from the master device 105 and controlling the electromagnet 145 to perform the requested action in the toy 125. For example, the controller 140 may drive a voltage across the electromagnet 145 which generates a magnetic field that affects a permanent magnet 130 fixed to the toy 125. Using the magnetic field, the electromagnet 145 applies a force to the permanent magnet 130 which, because the magnet 130 is fixedly disposed on the toy 125, causes the toy 125 to perform the action requested by the master device 105.

In one embodiment, the base controller 140 includes a list of predefined gameplay motion patterns which include parameters for controlling the electromagnet 140 to cause the toy 125 to perform a desired action or motion. Each of these patterns may correspond to a particular user action. For example, if the master device 105 determines that the user has performed a magical spell that causes an earthquake, the base controller 140 controls the electromagnet 145 in according with a gameplay motion pattern that causes the permanent magnet 130 (and thus, the toy 125) to simulate being affected by the user action—e.g., vibrate, shake, or fall down. The gameplay motion patterns may indicate the strength of the magnetic field, a desired change in the magnetic field, and/or the rate at which the magnetic field should change in order to induce the desired action in the toy 125.

Although FIG. 1A illustrates only one electromagnet 145 in the base 135, the base 135 may include multiple electromagnets which may be controlled separately. Moreover, the base controller 140 may activate the electromagnets in a synchronous manner to cause the toy 125 (e.g., an entertainment object) to perform a desired action.

As shown, the permanent magnet 130 is disposed at the bottom of the toy 125 closest to a top surface 155 of the base 135 on which the toy 125 rests. As such, in one embodiment, the toy 125 is not coupled to the base 135 using any mechanical couplers but rather sits unattached on the top surface 155 (also referred to as a support surface). However, in one embodiment, the base 135 may also include a permanent magnetic arranged near the center of the top surface 155. When the toy 125 is brought close to the base 135, the permanent magnet 130 in the toy 125 and the permanent magnet in the base 135 become magnetically coupled which can center the toy 125 on the top surface 155 and support the toy 125. The base controller 140 can activate the electromagnet 145, and in combination with magnetic force applied by the permanent magnet in the base 135, move the toy 125 in the desired motion.

The toy 125 may include multiple permanent magnets in addition to the one shown. For example, if the toy 125 includes appendages such as arms, a magnet may be disposed in each arm. Activating the electromagnet 145 may cause the arms to raise or lower. Moreover, multiple magnets (or simply a single larger magnet) may be disposed at the bottom of the toy 125 to increase the effect of the electromagnet 145 on the toy 125.

Figure 1B:
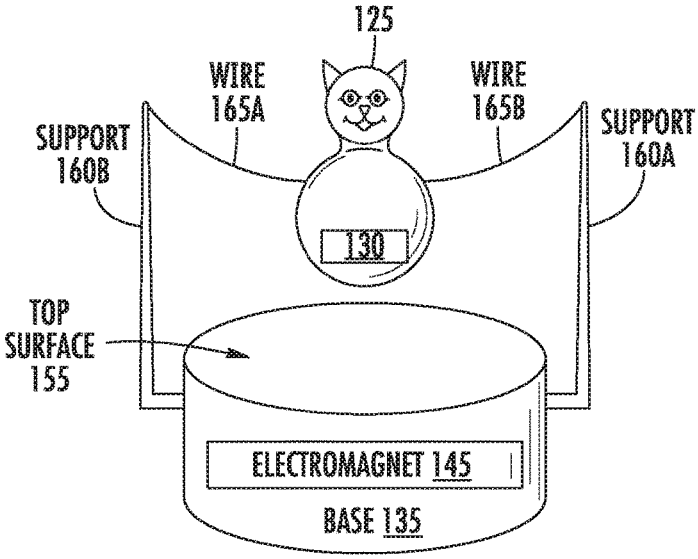
FIG. 1B is a system for using magnetism to cause a predefined action in a physical object, according to one embodiment presented herein.

FIG. 1B is a system for using magnetism to cause a predefined action in a physical object (e.g., toy 125), according to one embodiment presented herein. Instead of the toy 125 resting on the top surface 155, the toy 125 is suspended over the top surface 155 using a support system. However, the separation distance between the base 135 and the toy 125 is controlled so that the electromagnet 145 can still generate a magnetic field that causes the toy 125 to perform a predefined action. As used herein, the toy 125 is considered proximate to the top surface 155 so long as the permanent magnet 130 is affected by the magnetic field generated by the electromagnet 145. Suspending the toy 125 over the top surface 155 enable motions that may otherwise be impossible if the toy 125 is disposed on the surface 155 as shown in FIG. 1A. In one embodiment, the toy 125 is designed so that it can both be suspended over the top surface 155 as shown here, or resting on the top surface 155 as shown in FIG. 1A. Put differently, the same toy 125 can be used to perform predefined actions when the toy 125 is suspended as shown in FIG. 1B or resting on the top surface 155 as shown in FIG. 1A.

To suspend the toy 125, the base 135 includes supports 160 that extend in a direction perpendicular to the top surface 155. Although shown as being coupled to the base 135, in another embodiment, the supports 160 may not be mechanically coupled to the base 135 and instead rest on, for example, the same surface supporting the base 135—e.g., the floor, a tabletop, a desk, etc. Wires 165 couple the toy 125 to the supports 160 in order to suspend the toy 125 over the top surface 155. Using wires 165 which are flexible may mean the magnetic forces generated by the electromagnet 145 can cause greater movement in the toy 125 relative to using rigid connectors to couple the toy 125 to the supports 160. For example, with wires 165, the electromagnet 145 can output a magnetic field according to a gameplay motion pattern that causes the toy 125 to perform a flip—i.e., rotate around a center axis defined by the wires 165. Moreover, the electromagnet 145 can cause the toy 125 to swing back-and-forth (into and out of the page) using the wires 165.

Figure 2:
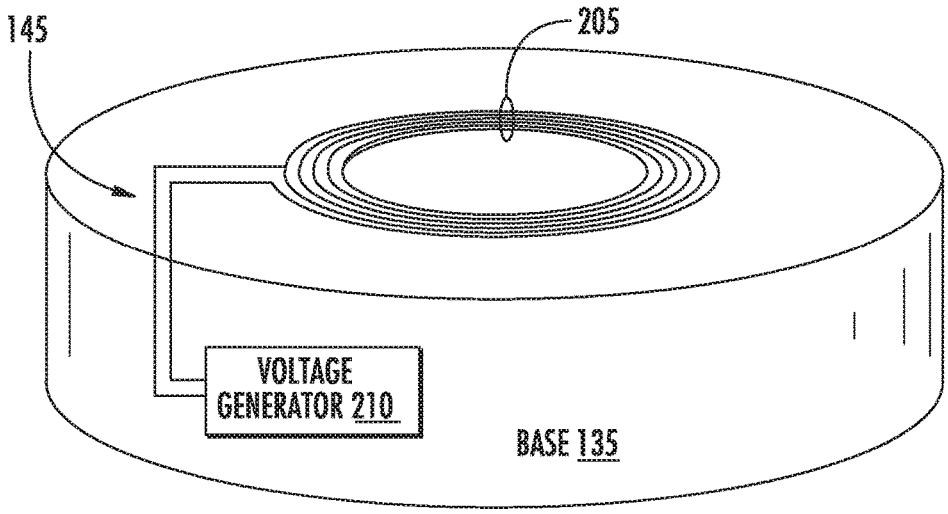
FIG. 2 illustrates a base for generating magnetic fields for moving a physical object, according to one embodiment presented herein.

FIG. 2 illustrates the base 135 for generating magnetic fields for moving the toy 125, according to one embodiment presented herein. For clarity, the top surface 155 of the base 135 is transparent so that the details of the electromagnet 145 can be viewed. As shown, the electromagnet 145 includes a coil 205 and a voltage generator 210. In one embodiment, the coil 205 is an electrically conductive wire wound in spiral along a common plane (i.e., so that the windings are concentric and with increasing radii) that is parallel to the top surface of the base 135. Alternatively, the wire may be wound in a spiral to form a cylindrical shape. Regardless, the coil 205 appears forms a circular loop when viewed from a direction or viewpoint perpendicular to the top surface 155. However, the precise shape of the spiral and the amount of times the wire wraps around are not critical so long as a magnetic field can be generated. For example, the coil 205 loop may form a square, triangle, or other shape.

Both ends of the wire forming the coil 205 are attached to the voltage generator 210. By creating a voltage difference between the two ends, the voltage generator 210 causes a current to flow through the wire thereby generating a magnetic field. At least one permanent magnetic on a toy (not shown) is within the magnetic field generated by the coil 205. Using the voltage generator 210, the base controller can activate and deactivate the magnetic field generated by the coil 205, as well as change the strength of the field and the rate at which the field changes. The different actions the electromagnet 145 can cause the toy to perform will be discussed below.

In another embodiment, the wire may be wound around a core shaped in a circle to generate the magnetic field. In yet another embodiment, instead of a loop or curved structure, the electromagnet 145 may be formed using a core that extends along a single axis. As above, the wire may be wound around the core and connected at both ends to the voltage generator 210.

In one embodiment, the coil 205 is held at a fixed position in the base 135. However, in other embodiments, the coil 205 is moveable within the base 135. For example, the coil 205 may be disposed on an actuator operable to move the coil 205 along one or more axes. The coil 205 could be disposed on a turntable thereby allowing the toy 125 to be rotationally manipulated. Alternatively or additionally, the coil 205 may be disposed on a x-y stage allowing the toy 125 to be moved to different positions on the top surface of the base 135

Figure 3:
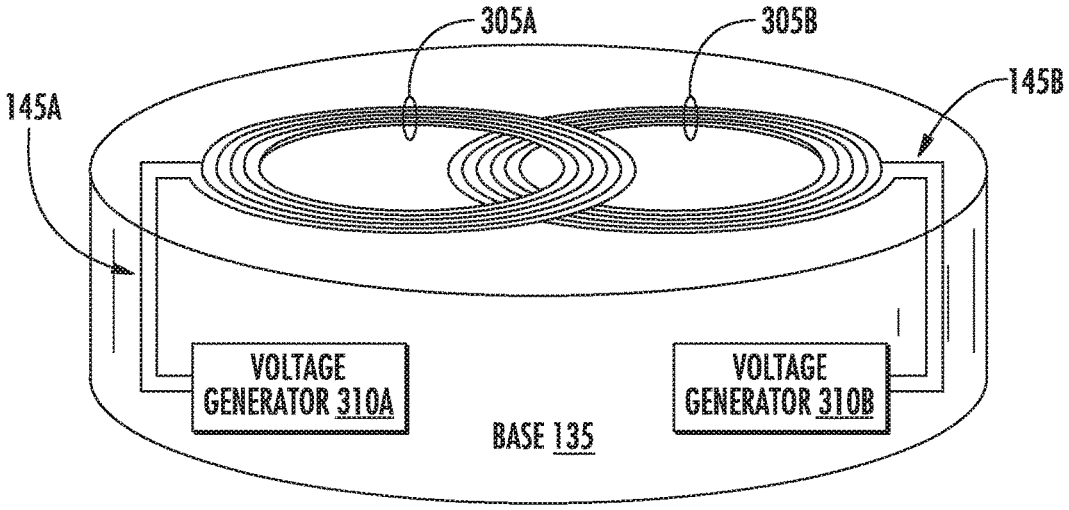
FIG. 3 illustrates a base for generating magnetic fields for moving a physical object, according to one embodiment presented herein.

FIG. 3 illustrates the base 135 for generating magnetic fields for moving the toy 125, according to one embodiment presented herein. As shown, the base 135 includes two electromagnets 145A, 145B that can be controlled separately. Each of the electromagnets 145 includes a respective coil 305 which can be shaped the same as the coil 205 shown in FIG. 2. Moreover, the coils 305 may have the same shape or different shapes. However, at least a portion of the coils 305 overlap. For example, the coil 305A may be disposed closer to the top surface of the base 135 than coil 305B (i.e., the coils 305 are not coplanar) so that at least a portion of coil 305A can be positioned between the coil 305B and the top surface.

The ends of the wires forming the coils 305 attach to separate voltage generators 310. As such, the base controller can separately control the magnetic fields generated by the coils 305. For example, the base controller can activate coil 305A, while coil 305B is deactivated. Moreover, the coils 305 can be activated simultaneously but with different strength fields or be driven using voltages of opposite polarity.

Figure 4A:
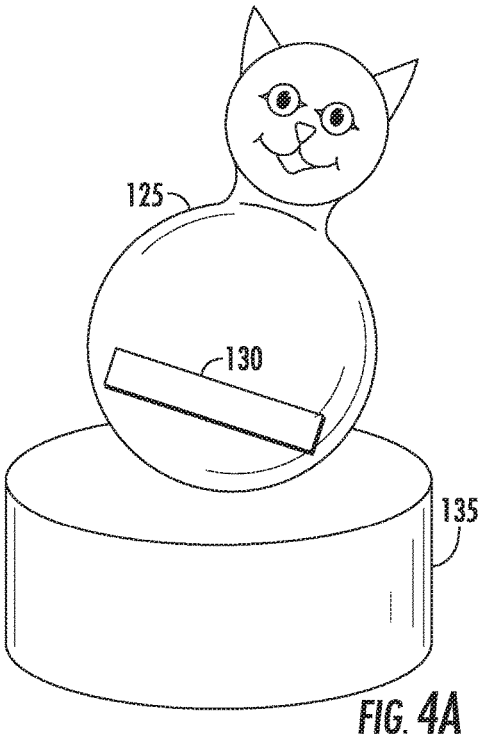
FIGS. 4A-4B illustrate a base using magnetism to move a physical object, according to one embodiment presented herein.
Figure 4B:
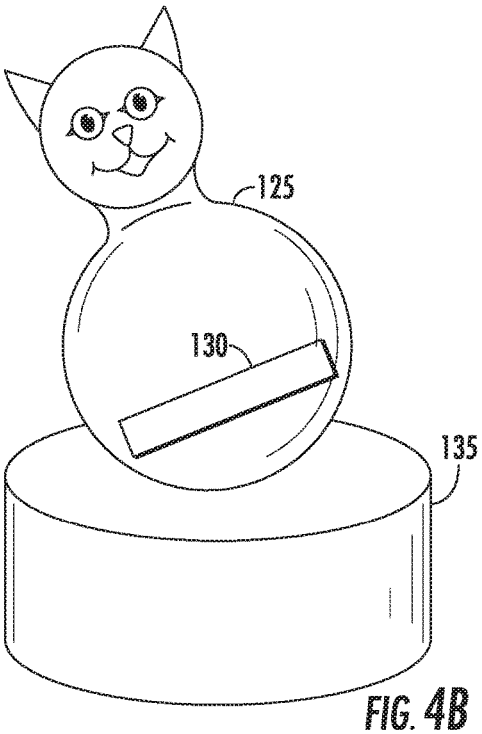

FIGS. 4A-4B illustrate the base 135 using magnetism to move the toy 125, according to one embodiment presented herein. In FIG. 4A, the permanent magnet 130 in the toy 125 is pulled by an electromagnet (not shown) in the base 135 such that the toy 125 leans to the right. For example, the base 135 may include the two electromagnets shown in FIG. 3 such that when the rightmost coil 305B is activated, the resulting magnetic field tips the toy 125 to the right. In FIG. 4B, the toy 125 is pulled (or repulsed) by one of the electromagnet in the base 135 so that the toy 125 leans to the left. Here, the rightmost coil 305B may be deactivated (or the field strength is reduced) while the leftmost coil 305A is activated and pulls the permanent magnet 130 towards the left side of the base 135. As a result, the toy leans to the left as shown.

The electromagnet or electromagnets in the base 135 may cause the toy 125 to sway back and forth at different angles and at different rates. For example, the base 135 may cause the toy 125 to sway at angles that are, or greater than, 45 degrees relative to the top surface of the base 135. Moreover, the controller may change the fields generated by the electromagnets such that it takes a second or more for the toy 125 to sway between the rightmost angle and the leftmost angle. In another embodiment, the toy may sway only a few degrees to the right and left and at a rapid rate (less than 100 milliseconds). In this example, the electromagnet causes the toy 125 device to vibrate. The swaying action and the vibration action may correspond to different predefined user actions—e.g., different hand gestures or different buttons on the master device. For example, if the user performs a magical spell that causes wind gusts, the base 135 may cause the toy 125 to sway back and forth slowly. However, if the user performs a spell that causes an earthquake, the base 135 causes the toy 125 to vibrate.

Figure 5:
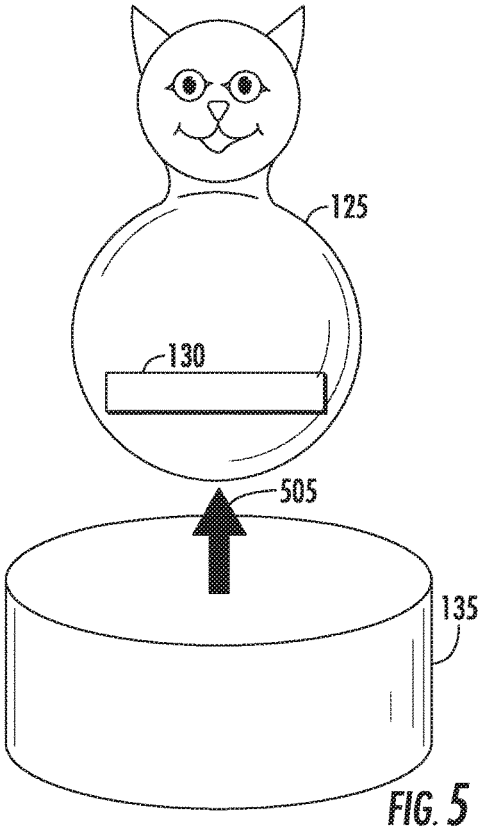
FIG. 5 illustrates a base using magnetism to move a physical object, according to one embodiment presented herein.

FIG. 5 illustrates the base 135 using magnetism to move the toy 125, according to one embodiment presented herein. Here, the base 135 controls its electromagnet (or magnets) to cause the toy 125 to jump in the air as indicated by the arrow 505. For example, the electromagnet, when activated, generates a magnetic field that repulses the permanent magnet 130 in the toy device 125. As a result, the entire toy 125 is moved in a direction perpendicular to the top surface of the base 135 and appears to leap or jump. The base 135 can deactivate the electromagnet which permits the toy device 125 to fall back onto the top surface. Alternatively, the base 135 may change the magnetic field so that instead of repulsing the toy 125, it attracts the toy 125 towards the top surface. One advantage of actively pulling the toy 125 back towards the base 135 is that the magnetic field can ensure the toy 125 lands in the desired spot on the top surface so that further actions can be performed on the toy 125. Like the swaying and vibrating actions described above, the jumping action shown in FIG. 5 may correspond to a predefined user action.

Figure 6:
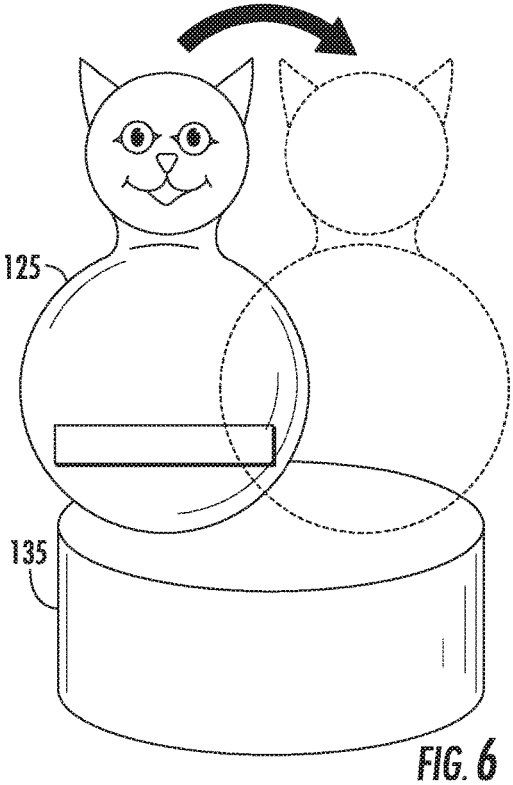
FIG. 6 illustrates a base using magnetism to move a physical object, according to one embodiment presented herein.

FIG. 6 illustrates the base 135 using magnetism to move the toy 125, according to one embodiment presented herein. As shown, the base 135 uses its electromagnets to slide the toy 125 along the top surface. Stated differently, by using the overlapped electromagnets 305 shown in FIG. 3, the base 135 can move the toy 125 from the position outlined by the solid lines to the position outlined by the dotted lines. For example, the base controller may reduce the voltage applied to the coil 305A while simultaneously increasing the voltage applied to the coil 305B which causes the magnetic field generated by coil 305B to pull or slide the toy 125 from the left side of the base 135 to the right side.

In one embodiment, the different actions shown in FIGS. 4-6 may be combined in a gameplay motion pattern and correlated to a single predefined user action. For example, the user may activate a button in the master device that causes the toy device 125 to perform a dance that includes several of the actions shown in FIG. 4-6. To perform the dance, the base 135 may cause the toy device 125 to sway back and forth as shown in FIGS. 4A and 4B and then perform a jump as shown in FIG. 5. Moreover, the dance may repeat these actions but either use different angles when swaying the toy 125 or different heights when jumping.

Generating 3D Positional Audio

Figure 7:
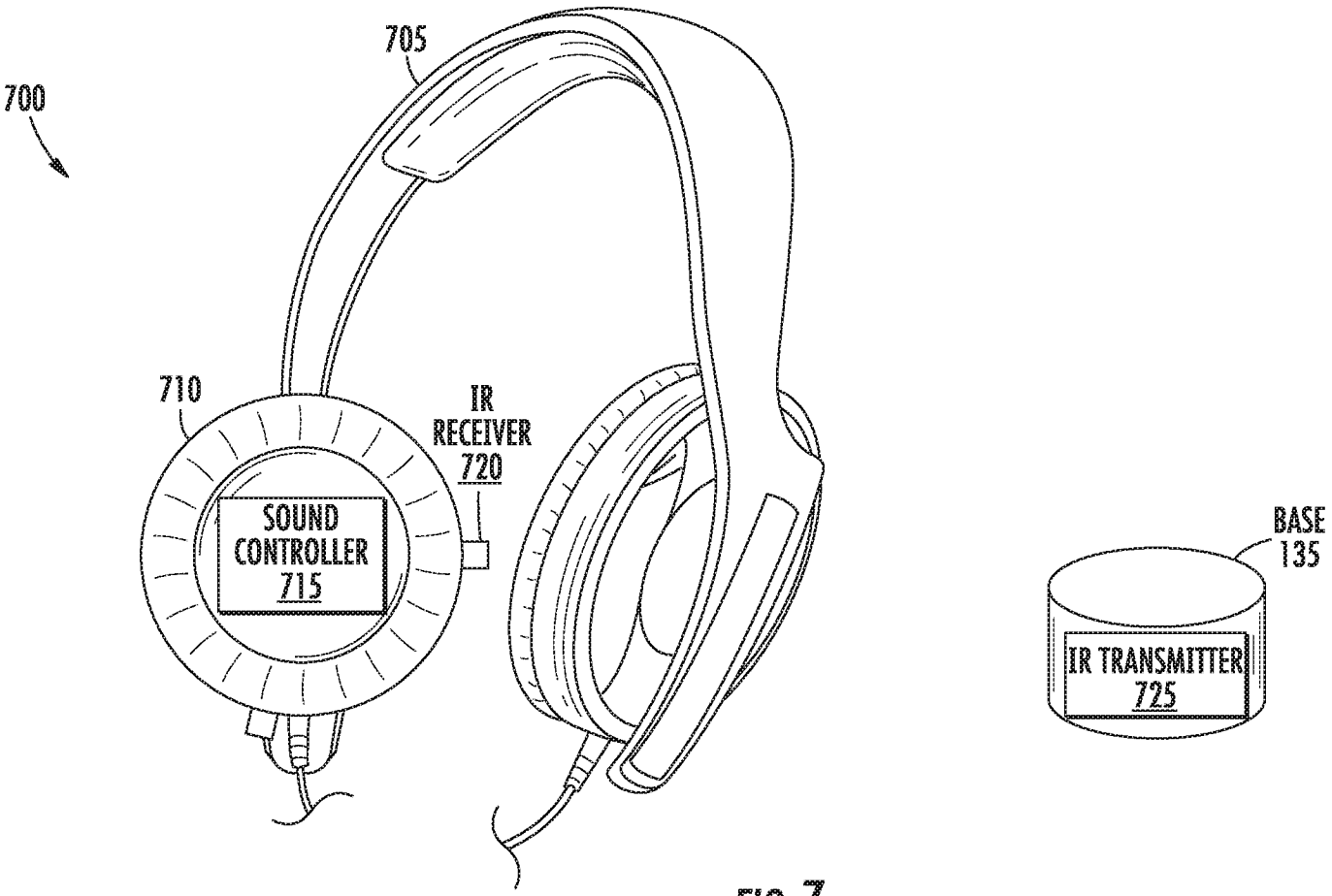
FIG. 7 is a system for generating stereophonic sound corresponding to a location of base, according to one embodiment presented herein.

FIG. 7 is a system 700 for generating 3D positional audio corresponding to a location of base, according to one embodiment presented herein. As shown, the system 700 includes headphones 705 (i.e., an audio system) and the base 135. In one embodiment, the headphones 705 include the same components and perform the same functions as the master device 105 shown in FIG. 1. In addition, the headphones 705 includes respective speakers 710 for each ear of the user and a sound controller 715 (e.g., an integrated circuit, firmware, and/or a software application) that generates stereophonic sound corresponding to the location of the base 135.

To determine the location of the base 135, the headphones 705 includes an IR receiver 720 which receives location signals emitted from an IR transmitter 725 on the base 135. In one embodiment, the IR receiver 720 is a directional receiver that receives signals transmitted from only a conical region extending away from the receiver 720. For example, the conical region may extend in the direction the user is facing when she is wearing the headphones 705. As such, if the user is looking at the base 135, then the IR receiver 720 will receive location signals emitted by the IR transmitter 725. However, if the user is facing in a direction opposite from the base 135, then the IR receiver 720 cannot receive the location signals emitted by the transmitter 725. As such, if the IR receiver 720 successfully receives the location signals from the IR transmitter 725, than the sound controller 715 knows that the IR transmitter 725 is located within the conical region corresponding to the IR receiver 720. From this, the sound controller 715 can generate an estimate of the 3D location of the IR transmitter 725 relative to the headphones 705. As will be described later, the headphones 705 may have other IR receivers 720 to identify base devices that may be disposed in other locations besides in front of the user—e.g., to the side of the user, behind the user, above the user, etc.

Once the location of the base 135 is identified, the sound controller 715 can output 3D positional audio that corresponds to the 3D location of the base 135. For example, if the sound controller 715 determines using the location signals that the base 135 is in front of the user, than the sound outputted by the speakers 710 is perceived by the user to originate in front of the user. Alternatively, if the headphones 705 determine the base 135 is currently to the side of the user, the sound controller 715 outputs 3D positional audio simulating that the sound originated from the side of the user at which the base 135 is currently located. In this manner, the base 135 does not need a speaker in order to audibly communicate with the user.

In one embodiment, the sound controller 715 stores and outputs sounds that correspond to a toy disposed on the base 135. For example, while the toy is performing one of the actions shown in FIGS. 4-6, the sound controller 715 synchronously outputs sound which, to the perspective of the user wearing the headphones 705, appears to originate from the toy on the base 135. In one example, as the base 135 causes the toy to vibrate in response to a magical spell causing an earthquake, the sound controller 715 outputs a sound in a voice corresponding to the toy that says, "Wow! This shaking is intense!" Because the 3D location of the base 135 (and thus, the toy) is known, the sound controller 715 outputs the voice to give the impression the voice originated from the direction of the base 135 relative to the user.

In one embodiment, the sound controller 715 determines the separation distance between the headphones 705 and the base 135 using the signals received from the base 135. In one example, the sound controller 715 evaluates the luminance of the of the IR signal emitted by the IR transmitter 725 to determine the separation distance. For example, the IR transmitter 725 may use a default intensity when transmitting the IR location signals. As a result, the sound controller 715 may map the received intensity of the IR location signal (which is attenuated relative to the default intensity) onto a range of predefined distances to identify the current separation distance. Alternatively, instead of using IR signals, the base 135 may transmit a radio signal to the headphones 705 which the sound controller 715 processes to identify the separation distance. For example, the sound controller 715 may use received signal strength indication (RSSI) to identify the distance between the base 135 and the headphones 705.

Once the separation distance is known, the sound controller 715 controls the volume of the stereophonic sound generated by the headphones 705 to simulate this distance. As the separation distance increases, the sound controller 715 may reduce the volume of the generated sound so the sound matches the environment seen by the user. For example, the sound controller 715 may simultaneously emit 3D positional audio corresponding to two bases 135 where one base 135 is in front of the user while the other is to the side of the user. If the base 135 in front of the user is farther away from the user than the base 135 to the side of the user, knowing the separation distance between the headphones 705 and the two bases 135 permits the sound controller 715 to control the stereophonic sound so that the sound corresponding to the toy on the base 135 to the side of the user is louder than the sound corresponding to the toy on the base 135 in front of the user.

In one embodiment, the sound controller 715 (and other hardware or power components) in the headphones 705 may be disposed separate from the speaker 710. For example, the sound controller 715 and a battery for powering the headphones 705 may be disposed in a separate enclosure that may be worn on neck, arm, or waist of the user. The enclosure and the headphones 705 may be communicatively coupled using a cable or a wireless link that permits the sound controller 715 to receive signals generated by the IR receiver 720 and provide sound for the speaker 710 to output.

Figure 8:
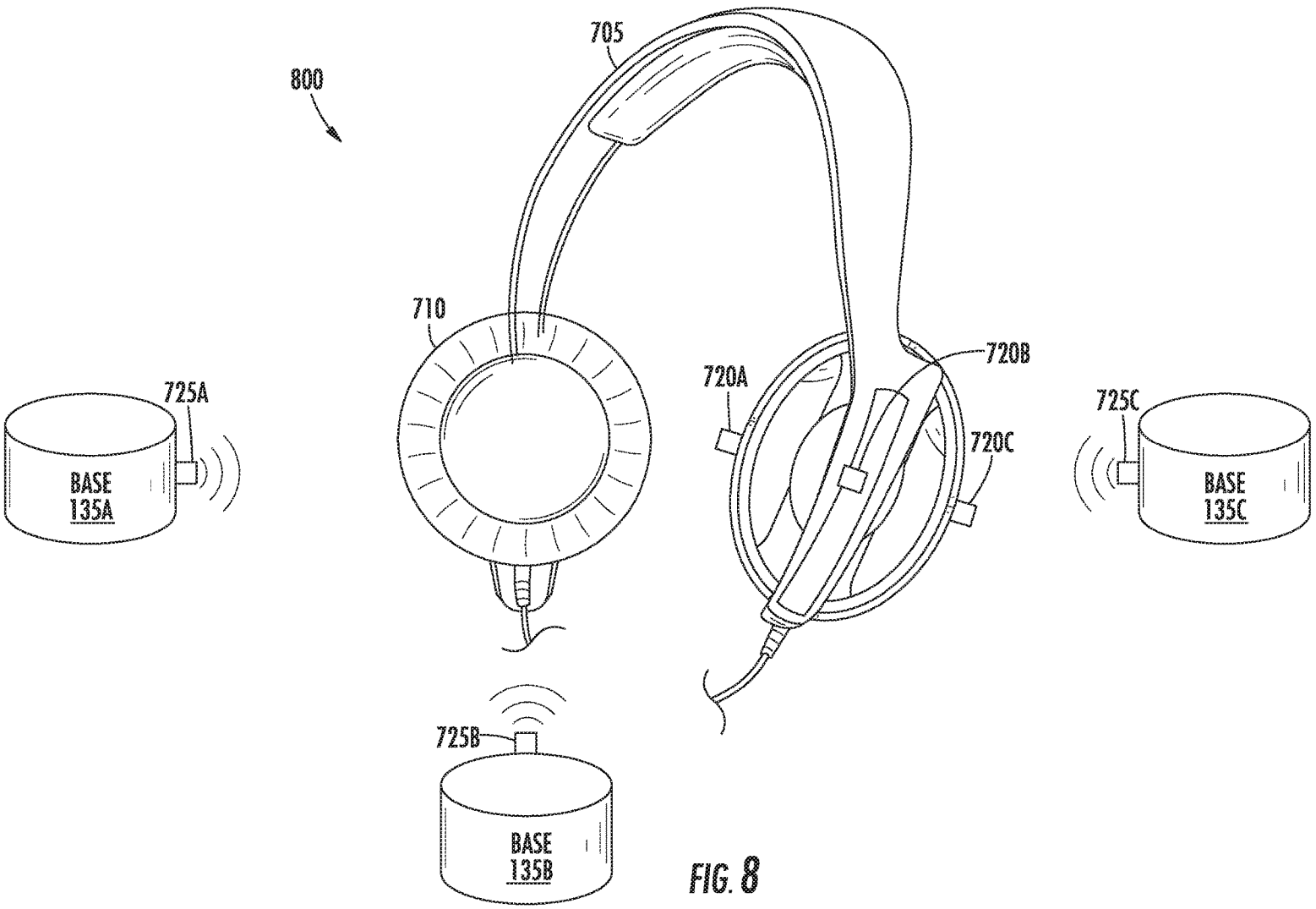
FIG. 8 is a system for generating stereophonic sound corresponding to a location of base, according to one embodiment presented herein.

FIG. 8 is a system 800 for generating 3D positional audio corresponding to locations of multiple base devices, according to one embodiment presented herein. As shown, the system 800 includes the headphones 705 along with multiple base devices 135 that are located at different 3D positions relative to the headphones 705. To determine the location of the bases 135, the headphones 705 include multiple IR receivers 720 which can receive IR location signals originating from individual conical regions. That is, the IR receiver 720A receives signals emitted from a conical region different from the region at which receiver 720B receives signals. For example, the IR signals emitted by an IR transmitter 725A are received at the IR receiver 720A but not at the IR receiver 720B. Although the respective conical regions of the IR receivers 720 may be non-overlapping, in other embodiments, some of the conical regions may overlap. If one of the base devices 135 is within the overlapping portion of the regions, two receivers 720 receive the location signal emitted from the base 135. Moreover, the location signals emitted by the bases 135 may include identification information that uniquely identifies the bases 135. The sound controller can use the information to determine what type of toy is disposed on each of the bases 135, and thus, what sound or voice corresponds to the bases 135. Although FIG. 8 illustrates using IR receivers 720 to determine a location of the base, other line-of-sight communication sources may be used such as visible light transmitters (e.g., red, green, or blue LEDs).

In system 800, the IR receivers 720 are arranged to separately receive locations signals emitted from the front, side and back of the headphones 705. Here, it is assumed the front of the headphones 705 is the side on which the IR receiver 720C is located while the back is the side on which IR receiver 720A is located. If a location signal is received at IR receiver 720B, the sound controller (not shown) knows one of the base devices—i.e., base 135B—is located on the right side of the user. In response, when outputting 3D positional audio corresponding to a toy on the base 135B, the sound controller simulates the sound as originating from the side of the user corresponding to IR receiver 720B. Moreover, the sound controller may update the location of the base devices 135 as the orientation of the headphones 705 or the location of the base devices 135 changes. For example, the user may turn her head such that base 135B is now in front of the user and base 135A is to the side of the user. The headphones 705 can detect this change since the location signals emitted by IR transmitter 425B is now received at IR receiver 720C rather than IR receiver 720B. Similarly, the light emitted by transmitter 725A of base 135A is received at IR receiver 720B rather than IR receiver 720A. Upon detecting a change in 3D location of a base 135, the sound controller changes the 3D positional audio to reflect the new locations of the base 135. For example, the sound controller may simulate the sound corresponding to the toy on base 135B moving from the side of the user to the front of the user.

If the conical regions of the IR receivers 720 overlap, the sound controller can more smoothly transition the locations of the bases 135 as the headphones 705 or the base devices 135 move. For example, the user may turn her head which changes the orientation of the headphones 705 relative to the bases 135, or the bases 135 may include wheels which permits them to move around the environment. If the conical regions of IR receivers 720B and 720C overlap, then as the user turns her head, at some point both receivers 720B and 720C (rather than only receiver 720B) receive signals from the IR transmitter 725B on base 135B. Thus, the sound controller determines that the base 135B is located to at a right diagonal direction relative to the user and can update the 3D positional audio accordingly. As the user or base device 135B continues to move, eventually the light emitted from the base device 135B is received only by IR receiver 720C. In response, the sound controller can again update the 3D positional audio to indicate to the user that the sound is being emitted from a source in front of the user where the base device 135B is now located. Of course, altering the 3D positional audio in response to changes in orientation of the headphones 705 or movement of the base 135B can be further smoothed by the addition of more directional IR receivers on the headphones 705. Thus, as the location signals emitted by the base devices 135 are received by different receivers 720, the sound controller can update the stereoscopic sound.

In another embodiment, instead of IR receivers 720, the headphones 705 may include multiple IR transmitters that emit directional signals. That is, instead of receiving light using a confined region, the IR transmitters emit IR signals within a confined conical region. For example, the IR transmitters may be arranged on the headphone 705 similar to the locations of the IR receivers 720 so that the conical regions of the transmitters cover the front, side, and back of the headphones 705. The base devices 135 may include IR receivers that, if the base device 135 is within a conical region, receive the signal emitted by the corresponding IR transmitter in the headphones 705. In response, the base device 135 transmits a confirmation signal back to the headphones 705 indicating the base 135 received the IR message. The confirmation message may include information that identifies the base 135 from other base devices in the system 800 or identifies the toy currently disposed on the base 135. Moreover, the confirmation message may include data indicating which of the IR transmitters on the headphones 705 emitted a signal that was received by the base 135. For example, each of the IR transmitters may transmit identification data that the base 135 then transmits back to the headphones 705 in the confirmation message so the headphones 705 can identify the conical region in which the base 135 is located. Because the confirmation message does not need to be directional, the base devices 135 may transmit these messages using a radio signal. As described above, once the location of the base 135 is identified, the sound controller can output 3D positional audio simulating to the user that the sound originated from the base 135.

In another embodiment, instead of IR transmitters or receivers, the headphones 705 may include one or more cameras to identify the location of an object such as the bases 135 relative to the headphones 705. For example, the base devices 135 may use the IR transmitters 725 or visible light LEDs to output a data signal which can be detected when the images captured by the camera are processed. In this manner, the images can be used to identify the locations of the bases 135 relative to the headphones 705. Moreover, the cameras may be disposed on the headphones 705 similar to the locations of the IR receivers 720 to provide multiple viewing angles and locate bases 135 that may be to the side or behind the user.

In one embodiment, the cameras can locate non-electronic objects in their field of view. Using standard image processing techniques, the headphones 705 can identify common items such as a coffee cup, table, chair, toy, etc. in the captured images. Even though these items may not be moved using the bases 135 shown in FIG. 8, the sound controller can still output stereoscopic sound that the user perceives as originating from the identified items. In this manner, the headphones 705 can change common household items into objects that interact with the user. In one embodiment, to aid the headphones 705 to identify the items, the user may place IR markers or paint on the common items which can be easily detected by processing the captured images.

Figure 9:
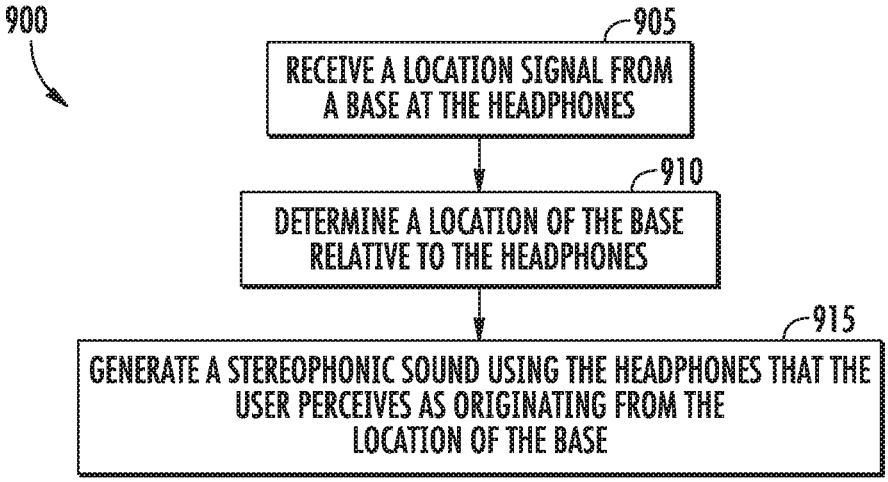
FIG. 9 is a flowchart for generating stereophonic sound corresponding to a location of base, according to one embodiment presented herein.

FIG. 9 is a flowchart of a method 900 for generating 3D positional audio corresponding to a location of a base device, according to one embodiment presented herein. At block 905, the headphones receive a location signal from a base device. As shown in FIG. 8, the headphones 705 have directional IR receivers 720 arranged at different locations on the headphones 705 to detect incoming light. Depending on which IR receiver 720 receives the location signal indicates to the headphones 705 the general location of the base device relative to the headphones 705. Alternatively, the headphones may use IR transmitters or cameras to identify the location of one or more base devices.

At block 910, the headphones determine the location of the base device relative to the headphones using the location signal. If the location signal is received using IR receivers, the conical region of the IR receiver is assigned the 3D location of the base device. Similarly, if the headphones use IR transmitters, the transmission region of the transmitters is assigned the 3D location of the base device. In this manner, the location signals received (or transmitted) by the headphones can be used to identify a 3D location or direction of the base device relative to the headphones. Alternatively, images generated by a camera can be processed to identify the location of the base devices or other objects.

At block 915, the headphones generate 3D positional audio that the user perceives as originating from the location of the base device. Moreover, in one embodiment, the 3D positional audio is updated if the user moves or changes the orientation of the headphones or the relative location of the base device changes. To do so, the headphones may use the location signals or the captured images to periodically update the 3D location of the base relative to the headphones. Knowing the location of the base relative to the headphones permits the sound controller to derive the location of the base relative to the user (assuming the user is currently wearing the headphones).

In one embodiment, the headphones may output 3D positional audio corresponding to virtual objects rather than the physical objects described above. In this example, the headphones do not need determine the location of the virtual objects but can assign a location to the virtual objects. For example, the headphones may output stereophonic sounds of bird calls simulating multiple virtual birds flying over the head of the user.

Figure 10:
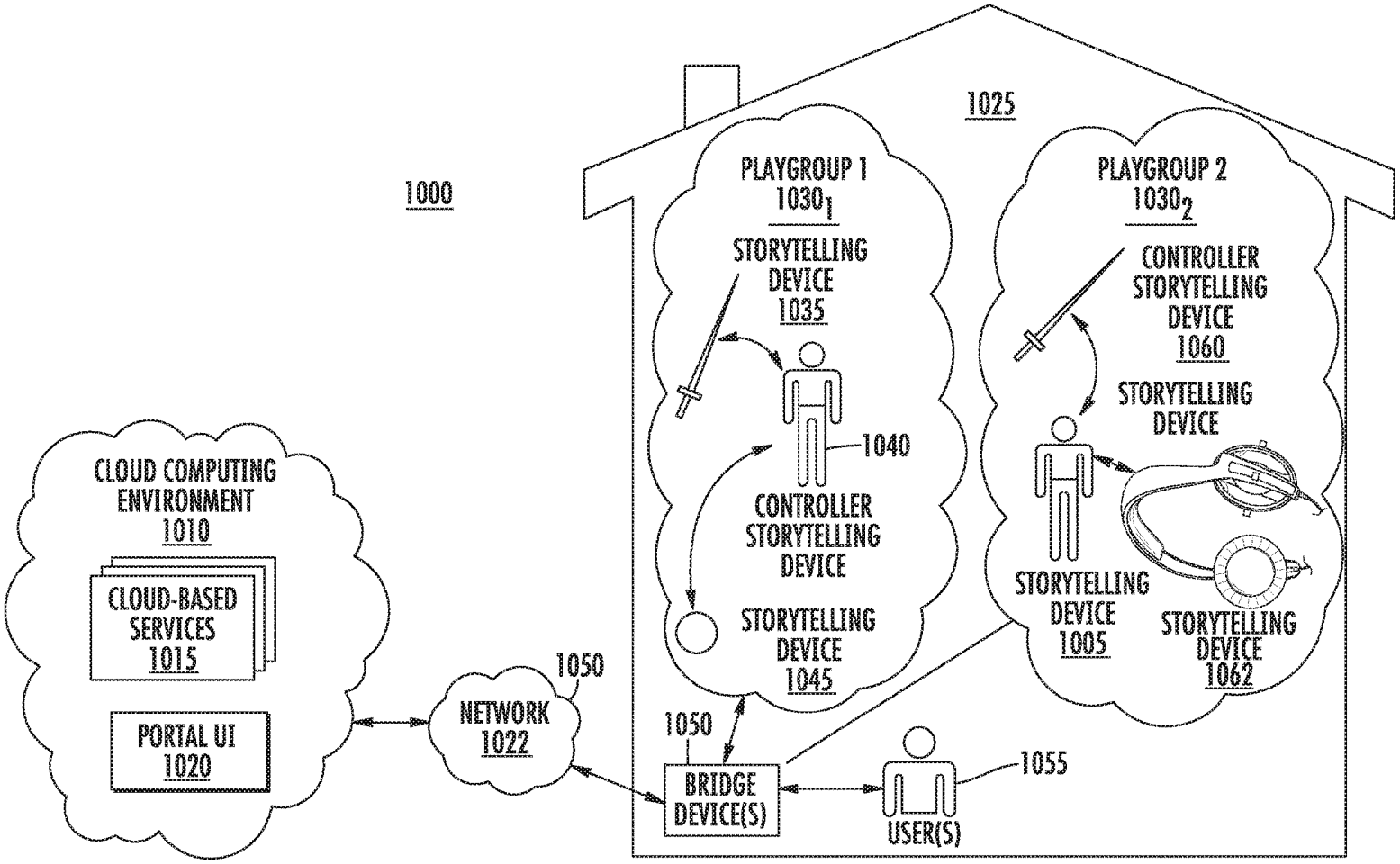
FIG. 10 illustrates an example storytelling environment, according to one embodiment.

FIG. 10 illustrates an example storytelling environment, according to one embodiment. As shown, the environment 1000 includes a cloud computing environment 1010 and a home environment 1025, interconnected via network 1022. The home environment 1025 includes two playgroups $\mathbf{1030}_{1\text{-}2}$ of storytelling devices (e.g., the toy device 125 or base 135 discussed in FIG. 1A), as well as a user(s) 1055 and a bridge device(s) 1050. Here, the user may connect to the bridge device 1050 via an application (e.g., executing on a mobile device, rendered within a web browser, etc.). The cloud computing environment 1010 hosts a plurality of services 1015 and a portal user interface 1020.

Generally, cloud computing generally refers to the provision of scalable computing resources as a service over a network. More formally, cloud computing may be defined as a computing capability that provides an abstraction between the computing resource and its underlying technical architecture (e.g., servers, storage, networks), enabling convenient, on-demand network access to a shared pool of configurable computing resources that can be rapidly provisioned and released with minimal management effort or service provider interaction. Thus, cloud computing allows a user to access virtual computing resources (e.g., storage, data, applications, and even complete virtualized computing systems) in "the cloud," without regard for the underlying physical systems (or locations of those systems) used to provide the computing resources.

Typically, cloud computing resources are provided to a user on a pay-per-use basis, where users are charged only for the computing resources actually used (e.g. an amount of storage space consumed by a user or a number of virtualized systems instantiated by the user). A user can access any of the resources that reside in the cloud at any time, and from anywhere across the Internet. Doing so allows a user to access information and the services 1015 from any computing system attached to a network connected to the cloud (e.g., the Internet).

Each playgroup $\mathbf{1030}_{1\text{-}N}$ generally represents a set of storytelling devices involved in a unique storytelling or playtime experience. For instance, the playgroup $\mathbf{1030}_1$ represents a science fiction-themed storytelling experience and includes a light sword storytelling device 1035, an action figure controller storytelling device 1040, and a trainer storytelling device 1045. Likewise, the playgroup $\mathbf{1030}_2$ also represents a science fiction-themed storytelling experience and includes a light sword controller storytelling device 1060, headphones 1062 (e.g., headphones 705 in FIG. 7), and an action figure storytelling device 1065. More generally, however, the playgroups may contain any number of storytelling devices of any number of different themes and types.

Generally, the playgroups 1030 include storytelling devices within a particular physical location (e.g., a room of the house environment 1025). That is, in one embodiment, it may be preferable for a storytelling experience to only interact with storytelling devices within its immediate physical proximity (e.g., within the same room), as to do otherwise can potentially create security and other problems during the storytelling experience. A number of different techniques may be used to determine which storytelling devices are within immediate physical proximity of one another. For example, one or more of the storytelling devices could emit a first signal (e.g., an infrared signal) and the other storytelling devices could be configured to transmit a response (e.g., a radio frequency signal (RF)) upon receiving the first signal. The storytelling device(s) could then receive the responses from the other storytelling devices and could create a playgroup 1030 that includes the other storytelling devices as well as the one or more storytelling devices. Moreover, although cloud computing environment 1510 is shown, in other embodiments, the devices in the play groups 1030 may communicate only with each other without using the bridge device 1050 and network 1055.

As shown, the devices 1040 and 1060 have been elected as controller devices within the playgroups $\mathbf{1030}_{1\text{-}2}$. Generally, a controller device configures each of the storytelling devices within a playgroup to perform certain actions in response to a detected stimulus event and a current context of the story being told. Here, the story may include a number of different contexts in a temporal order, and the playback of the story may advance from one context to the next until the last context is reached and the storytelling experience is complete. However, while the story may be linear in progression, this is not necessary. For example, a story could have different branches so that the story can proceed down one of many possible arcs. For instance, arcs could be randomly selected, selected based on a user's request (e.g., the user specifying which arc should be taken), selected based on the user's actions (e.g., the user manages to "rescue" one of the fictional characters in the story), selected based on the user's history of actions (e.g., whether the user is trending towards the "dark side" in a science fiction storyline), and so on. Moreover, the story may be modified dynamically during playback based on various actions, such as one of the storytelling devices becoming unavailable (e.g., losing power, leaving the physical environment, etc.) or a new storytelling device being introduced to the environment (e.g., the user's friend comes over to play, bringing one or more new storytelling devices with him).

Additionally, the controller may maintain state information and control game logic for the playgroup 1030. For example, playgroup $\mathbf{1030}_1$ could be playing out a story in which a user is asked by the action figure device 1040 to deflect virtual laser beams fired from the trainer device 1045, using the light sword device 1035. Here, the elected controller device (i.e., action FIG. 1040) could maintain a "hit points" value for the user that is decremented when the user fails to deflect one of the virtual lasers, and could further maintain a count of how many virtual lasers the user has deflected thus far. Additionally, the controller could retrieve state data for the user (e.g., by querying one of the cloud-based services 1015 with an identifier for the user) and could use the user state data to adjust the playback of the story.

In addition to detecting nearby storytelling device within the same physical environment, the storytelling devices within a playgroup 1030 may elect one of the storytelling devices as a controller storytelling device. A number of different techniques may be used for such an election. For example, a user could explicitly specify that a particular one of the storytelling devices (e.g., the user's favorite device) should be used as the controller. Here, it may be preferable for the user to select a device that will remain with the user throughout the storytelling experience, so as to avoid a subsequent controller election part-way through the story. In one embodiment, the controller may be elected based on technical specifications and properties of the storytelling devices. For example, a storytelling device with a substantial amount of memory, processing power and communication bandwidth may be preferable as the controller, relative to a device having a lesser amount of computing resources.

As discussed above, the story may generally include stimulus events and corresponding actions, and may be linear in progression or dynamic (e.g., a story that includes different story arcs or branches). In one embodiment, the story may be defined such that each corresponding action is attribute to a type or role of storytelling device (i.e., as opposed to a specific storytelling device). In mapping the story to the available and compatible storytelling devices, the controller device 1020 could determine a type of each of the storytelling devices, and could assign particular stimulus events and corresponding actions to each of the storytelling devices based on the determined type. For example, a particular story could state that an action should be performed by a storytelling device having the role of "Hero", and the controller could map the action onto a storytelling device within the playgroup having the role "Hero".

Once the controller maps the story onto the devices, the controller configures each of the storytelling devices with a number of stimulus events and corresponding effects relating to a first context of the story. As an example, the action FIG. 1040 could detect when the user has successfully deflected a virtual laser fired from the storytelling device 1045 (i.e., an occurrence of the stimulus event), and could audibly congratulate the user in response (i.e., performing the corresponding effect).

In the preceding, reference is made to embodiments of the invention. However, it should be understood that the invention is not limited to specific described embodiments. Instead, any combination of the preceding features and elements, whether related to different embodiments or not, is contemplated to implement and practice the invention. Furthermore, although embodiments of the invention may achieve advantages over other possible solutions and/or over the prior art, whether or not a particular advantage is achieved by a given embodiment is not limiting of the invention. Thus, the aspects, features, embodiments and advantages described herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order or out of order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the foregoing is directed to embodiments of the present invention, other and further embodiments of the invention may be devised without departing from the basic scope thereof, and the scope thereof is determined by the claims that follow

What is claimed is:

1. An apparatus, comprising:

a base comprising a support surface;

a first electromagnet disposed in the base and configured to generate a first magnetic field at the support surface, wherein the first electromagnet comprises:

a first coil formed from a first electrically conductive wire, wherein the first coil forms a first loop from a viewpoint perpendicular to the support surface, wherein the first electromagnet has only the first coil, and a voltage generator coupled to both ends of the first wire;

a controller disposed in the base and configured to control the first magnetic field generated by the first electromagnet according to a predefined gameplay motion pattern configured to induce an entertainment object proximate to the support surface to perform a desired action causing spatial separation of the entertainment object relative to the support surface; and a second electromagnet configured to generate a second magnetic field at the support surface according to the predefined gameplay motion pattern, wherein the second electromagnet has only a single second coil formed from a second electrically conductive wire, wherein the second coil forms a second loop from the viewpoint perpendicular to the support surface, and wherein the base comprises at most two coils;

wherein the first coil is disposed a first distance from the support surface, and the second coil is disposed a second distance from the support surface, wherein the first coil overlaps the second coil relative to the viewpoint perpendicular to the support surface.

2. The apparatus of claim 1, wherein the controller is configured to:

synchronously control the first electromagnet and the second electromagnet using the gameplay motion pattern to generate the desired action using the entertainment object.

3. The apparatus of claim 2, wherein the desired action comprises: the entertainment object jumping on the support surface and the entertainment object swinging above the support surface.

4. The apparatus of claim 1, wherein the controller is configured to:

activate the first electromagnet using the voltage generator to repulse a permanent magnet in the entertainment object such that the entertainment object jumps on the support surface; and activate the first electromagnet using the voltage generator, when the entertainment object is jumping on the support surface, to attract the permanent magnet such that the entertainment object lands in a desired location on the support surface.

5. The apparatus of claim 1, wherein the entertainment object is not mechanically coupled to the apparatus.

6. A system comprising:

a base comprising a body, wherein the body comprises:

an electromagnet configured to generate a magnetic field at a support surface, a controller configured to control the magnetic field generated by the electromagnet to induce an entertainment object proximate to the support surface to perform a desired action, and a wireless transmitter configured to emit a location signal; and an audio system comprising:

a plurality of speakers, at least one receiver configured to receive the location signal, and a sound controller configured to:

determine a location of the base relative to the audio system based on the location signal, and output 3D positional audio using the speakers that a user perceives as originating from the location of the base.

7. The system of claim 6, wherein the electromagnet comprises:

a coil formed from an electrically conductive wire, wherein the coil forms a loop relative to a viewpoint perpendicular to the support surface; and a voltage generator coupled to both ends of the wire.

8. The system of claim 6, wherein the audio system includes a plurality of wireless receivers that includes the receiver, wherein each of the wireless receivers is disposed on the audio system to receive the location signal from different defined regions.

9. The system of claim 8, wherein the location of the base is imputed to a respective defined region corresponding to one of the wireless receivers that receives the location signal.

10. The system of claim 6, wherein the audio system includes a plurality of wireless transmitters, each of the wireless transmitters is configured to emit signals to different defined regions, and wherein the base includes an wireless receiver configured to receive the signals emitted by the wireless transmitters.

11. The system of claim 10, wherein the base is configured to uniquely identify one of the plurality of wireless transmitters based on the received signals and transmit a confirmation message comprising the location signal to the audio system indicating the identified one of the plurality of wireless transmitters.

12. The system of claim 6, further comprising a plurality of bases, wherein the sound controller is configured to:

determine respective locations corresponding to each of the bases, and simultaneously output 3D positional audio corresponding to each of the bases using the speakers such that the user perceives the 3D positional audio as originating from the respective locations of the bases.

13. A method, comprising:

activating, by a controller, an electromagnet in a base to affect a permanent magnetic fixedly disposed on an entertainment object to cause the entertainment object to perform a desired action when the entertainment object is proximate to a support surface of the base;

receiving a location signal transmitted by a wireless transmitter in the base at an audio system, wherein the base comprises a body, wherein the body comprises the controller, the electromagnet and the wireless transmitter;

determining a location of the base relative to the audio system based on the location signal; and generating 3D positional audio using the audio system that a user perceives as originating from the location of the base, wherein the 3D positional audio is output synchronously with the desired action performed by the entertainment object.

14. The method of claim 13, wherein the location signal is a wireless signal that is received at one of a plurality of receivers disposed on the audio system, wherein each of the receivers is disposed on the audio system to receive the location signal from different defined regions.

15. The method of claim 13, further comprising:

transmitting an IR signal from the audio system to the base, wherein the signal includes data uniquely identifying one of a plurality of transmitters disposed on the audio system, and wherein the location signal is transmitted from the base to the audio system in response to receiving the signal.

16. The method of claim 13, further comprising:

receiving location signals from a plurality of bases;

determining respective locations of the plurality of bases relative to the audio system based on the received location signals; and outputting 3D positional audio corresponding to each of the plurality of bases, wherein the user perceives the 3D positional audio as originating from the respective locations of the plurality of bases.

17. The method of claim 13, wherein the desired action comprises: the entertainment object jumping on the support surface, the entertainment object sliding along the support surface, and the entertainment object swaying back and forth relative to the support surface.

* * * * *